US009609998B1

(12) United States Patent
Sherrett

(10) Patent No.: US 9,609,998 B1
(45) Date of Patent: Apr. 4, 2017

(54) GLASSWARE AND SILVERWARE STEAMER

(71) Applicant: Daniel Vincent Sherrett, Upper Marlboro, MD (US)

(72) Inventor: Daniel Vincent Sherrett, Upper Marlboro, MD (US)

( * ) Notice: Subject to any disclaimer, the term of this patent is extended or adjusted under 35 U.S.C. 154(b) by 0 days.

(21) Appl. No.: 15/012,231

(22) Filed: Feb. 1, 2016

(51) Int. Cl.
*A47L 15/00* (2006.01)
*A47L 15/42* (2006.01)

(52) U.S. Cl.
CPC ..... *A47L 15/4234* (2013.01); *A47L 15/0089* (2013.01)

(58) Field of Classification Search
CPC ..... A47L 15/4234; A47L 15/00
See application file for complete search history.

(56) References Cited

U.S. PATENT DOCUMENTS

2009/0314316 A1* 12/2009 Hall ..... A47L 15/4234 134/198
2010/0154842 A1* 6/2010 Burgess ..... A47L 15/4234 134/108

FOREIGN PATENT DOCUMENTS

| | | | |
|---|---|---|---|
| EP | 1775216 | A1 | 4/2007 |
| GB | 2307974 | A | 6/1997 |
| JP | H10234352 | A | 9/1998 |

* cited by examiner

*Primary Examiner* — Jason Ko
(74) *Attorney, Agent, or Firm* — Laubscher, Spendlove & Laubscher, P.C.

(57) ABSTRACT

A device for steaming utensils such as silverware and glassware includes a frame having side and bottom walls. The frame has an open upper end. A heating chamber containing at least one heating device is connected with and depends from the frame bottom wall. A fluid reservoir is arranged within the frame and rests on the frame bottom wall. When fluid such as water is arranged in the reservoir and the heating device is operated, the water is heated to generate steam which exits the frame open upper end. One or more racks containing the utensils to be steamed are arranged on the device. The steam cleans the utensils for subsequent polishing.

7 Claims, 1 Drawing Sheet

GLASSWARE AND SILVERWARE STEAMER

BACKGROUND OF THE INVENTION

In the food service industry, and particularly in fine dining establishments, cleanliness of the eating utensils including glassware and silverware is of paramount importance. Even after cleaning of the utensils in commercial washing machines or by hand washing, it is common for smudges, water spots, lipstick and fingerprints to be retained on the surface, thus requiring the service staff to manually polish each utensil. To assist with polishing, the staff often steams the utensils. This is accomplished either through use of an electric steaming device, similar to a tea kettle, which directs steam against individual articles of glassware or silverware, or by arranging a number of utensils in a plastic bin which contains hot water to generate steam for the articles in the bin. Using either technique increase the time and labor to obtain properly cleaned utensils.

BRIEF DESCRIPTION OF THE PRIOR ART

Steaming devices are well-known in the patented prior art as evidenced by the EP Patent No. 1775216, the GB patent No. 2307974 and the JP patent No. 10234352. The EP patent No. 1775216 for example, discloses a steaming device for food trays in which steam is delivered to the trays via air circulating ducts to clean the trays.

While the prior devices operate satisfactorily, they do not afford simple and efficient cleaning of a plurality of glasses or eating utensils. The present invention was developed in order to provide an economical, durable and simply designed steaming device for simultaneously preparing for polishing a large number of glassware/silverware articles arranged in conventional commercial racks or trays with a minimum of training for hospitality staff already familiar with devices such as chafing dishes.

SUMMARY OF THE INVENTION

Accordingly, it is a primary object of the invention to provide a device for steaming utensils such as glassware and silverware including a frame having side walls and a bottom wall connected with the side walls. The frame is open at its upper end. A heating chamber is arranged beneath the frame and depends from the frame bottom wall. The heating chamber also includes a bottom wall and plurality of side walls. A fluid reservoir is arranged within the frame and rests on the frame bottom wall above the heating chamber. The fluid in the reservoir is heated by the heating chamber to generate steam which exits the frame open end to steam a plurality of utensils arranged in trays or racks stacked on the device. The steam cleans the utensils to facilitate polishing of the utensils prior to use.

The heating chamber preferably contains at least one heating device such as a canister containing a flammable composition which can be operated when the device is in use to heat the fluid in the reservoir and extinguished when the device is not in use.

According to a further object of the invention, the upper edges of the side walls of the device include a lip which mate with a bottom edge of the utensil racks stacked on the device so that the stacked racks are stable and define an open topped chamber in which a plurality of utensils are steamed simultaneously.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
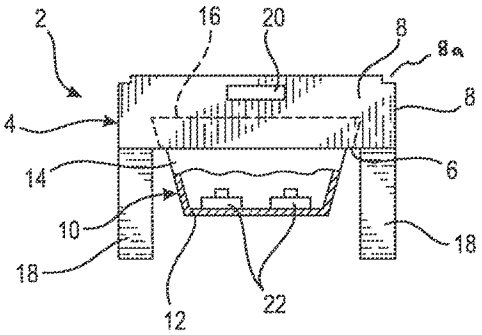
FIGS. 1 and 2 are front and top views, respectively, of a glassware and silverware steaming device according to the invention.
Figure 2:
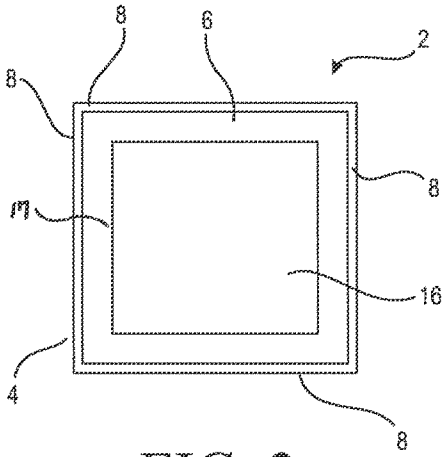

Referring first to FIGS. 1 and 2, the steaming device 2 according to the invention will now be described. The device is particularly suitable for steaming utensils such as glassware and silverware, but can also be used to steam pots, pans, bowls and other kitchen implements used in the food service industry. The device includes a frame 4 having a bottom wall 6 and a plurality of side walls 8 connected with the bottom wall. The frame is open at its upper end.

Beneath the frame and depending from the frame bottom wall 6 is a heating chamber 10 which also includes a bottom wall 12 and a plurality of side walls 14. A fluid reservoir 16 is arranged within the frame and rests on the frame bottom wall. Preferably, the bottom wall of the frame also serves as the bottom wall of the reservoir. The reservoir includes side walls 17 spaced from the frame side walls 8 as shown in FIGS. 1 and 2. A fluid, preferably water, is arranged in the reservoir. The fluid is heated by the heating chamber to generate steam which exits the frame through the open upper end. A plurality of legs 18 are connected with the frame bottom wall to space the frame from the surface on which the device is supported and to provide ventilation to the heating chamber. Each of the opposed side walls of the frame preferably contain an opening 20 which a user may use to lift the frame. In addition, the openings provide an alternate venue for adding fluid to the fluid reservoir as will be discussed below.

The heating chamber contains at least one heating device. In the preferred embodiment of the invention, the heating device is a portable and replaceable canister 22 containing a flammable composition which may be activated when the device is in use and extinguished when not in use. Other suitable heating devices such as an electric coil or a gas burner may also be used for the heating devices within the heating chamber.

The steaming device is formed of any suitable rigid material such as metal or synthetic plastic. It is preferred that the bottom wall 6 of the frame and fluid reservoir be formed of a heat transmissive material such as metal and that the walls of the heating chamber be formed of a heat insulating material so that individuals using the device are not burned by the heating chamber when in use.

Figure 3:
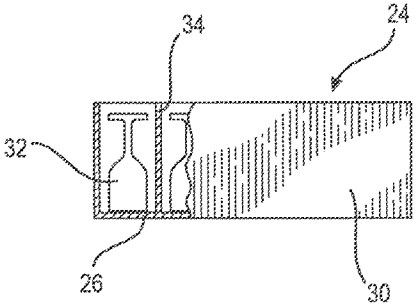
FIGS. 3 and 4 are front and top views, respectively, of a rack for holding a plurality of utensils to be steamed.
Figure 4:
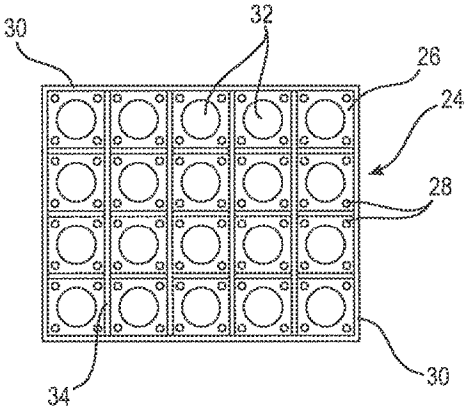

Referring now to FIGS. 3 and 4, a stackable tray or rack or 24 for holding a plurality of utensils will now be described. The rack includes a bottom wall 26 in the form of a grate containing a plurality of openings 28 and a plurality of side walls 30 connected with the bottom wall. The side walls are preferably solid without any openings. The top of the rack is open to receive a plurality of utensils such as glasses 32 which fit into compartments defined by interior walls 34 of the rack. The racks are preferably formed of a lightweight rigid material such as synthetic plastic. Other types of racks with different interior configurations may be provided to receive silverware, bowls, plates, pans, or other kitchen utensils which are to be steamed for cleaning.

Figure 5:
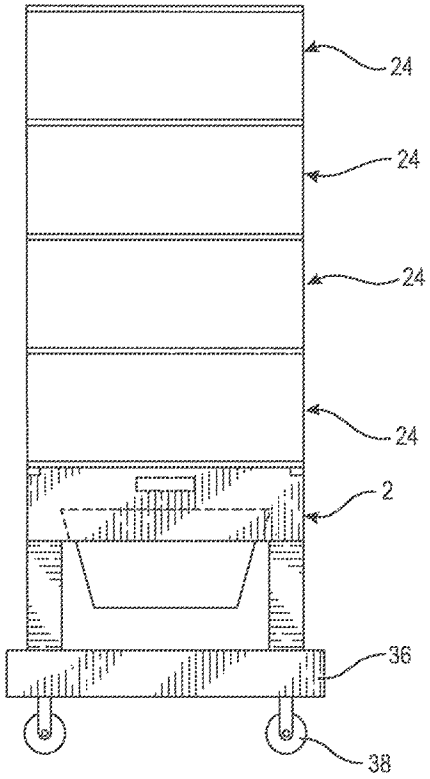
FIG. 5 is a front view of the steaming device of FIGS. 1 and 2 having a plurality of racks of FIGS. 3 and 4 stacked thereon.

The steaming device 2 is designed to support a plurality of stackable racks as shown in FIG. 5. Preferably, the upper edge of the side walls 8 of the device include a lip 8*a* which is configured to mate with a recess in the bottom peripheral edge of the racks 24. This allows a plurality of racks to be stacked on the device. With water arranged in the fluid reservoir of the steaming device, the heating elements in the heating chamber are activated to heat the water and generate steam. The steam rises from the device 2 and is transported through a column of stacked racks defined by the solid side walls of the racks. With each rack containing a plurality of utensils, the utensils can be uniformly warmed and steamed simultaneously with a higher level of sanitation and less water waste than is obtained with prior steaming devices and practices. This insures that the utensils can be polished more effectively by the kitchen staff. In addition, the openings 20 in the side walls of the device afford and alternate venue for replenishing the water in the fluid reservoir.

The steaming device may fit on a standard glassware/silverware trolley or cart 36 which has wheels 38 which allow the entire assembly shown in FIG. 5 to be easily transported from a kitchen to a dining area so the dining tables can be set with freshly cleaned.

While the preferred forms and embodiments of the invention have been illustrated and described, it will be apparent to those of ordinary skill in the art that various changes and modifications may be made without deviating from the inventive concepts set forth above.

What is claimed is:

1. Apparatus for steaming utensils, comprising (a) a frame including side walls and a bottom wall connected with said side walls, said frame being open at its upper end;

(b) a heating chamber arranged beneath said frame and depending from said frame bottom wall, said heating chamber including a bottom wall and a plurality of side walls; and (c) a fluid reservoir arranged within said frame and including a plurality of side walls spaced from said frame side walls resting on said frame bottom wall above said heating chamber, said fluid reservoir containing a fluid which is heated by said heating chamber via said frame bottom wall to generate steam which exits said frame open upper end, whereby when at least one rack containing utensils is arranged on said frame side walls above said frame open upper end, the steam from said fluid reservoir cleanses the utensils to facilitate polishing thereof.

2. Apparatus as defined in claim 1, wherein said heating chamber includes at least one heat source.

3. Apparatus as defined in claim 2, wherein said heat source comprises a canister containing a flammable composition.

4. Apparatus as defined in claim 2, wherein said frame side walls contain a lip in an upper edge thereof, whereby the at least one rack of utensils is connected with said lip to define an open top enclosure for steaming the utensils.

5. Apparatus as defined in claim 4, wherein said frame includes a plurality of legs connected with said bottom wall for supporting said frame.

6. Apparatus as defined in claim 5, and further comprising wheels connected with said legs, whereby said frame is mobile.

7. Apparatus as defined in claim 4, wherein at least two opposed frame side walls contain openings which allow access to said fluid reservoir when a plurality of trays are arranged on said frame and which allow a user to lift said frame.

* * * * *